United States Patent [19]

Eberhardt

[11] 4,097,742

[45] Jun. 27, 1978

[54] THERMAL CAMERA TUBE

[75] Inventor: Edward Herbert Eberhardt, Fort Wayne, Ind.

[73] Assignee: International Telephone & Telegraph Corporation, Nutley, N.J.

[21] Appl. No.: 800,593

[22] Filed: May 25, 1977

[51] Int. Cl.[2] ..... H01J 31/49

[52] U.S. Cl. ..... 250/333; 250/338

[58] Field of Search ..... 250/333, 338, 340; 358/113

[56] References Cited

U.S. PATENT DOCUMENTS

| | | | |
|---|---|---|---|
| 1,936,514 | 11/1933 | Lengnick | 250/333 X |
| 4,032,783 | 6/1977 | Koda | 250/333 |

*Primary Examiner*—Davis L. Willis

*Attorney, Agent, or Firm*—John T. O'Halloran; Alfred C. Hill

[57] ABSTRACT

A thermal retina disposed in a vacuum envelope receives thermal radiation emitted from an object being viewed includes a semiconductor bolometric thin film target, a metallic heat sink mesh disposed between the thermal radiation and the target to support the target where the heat sink mesh has webs to define web areas of the target and holes surrounded by the webs to define hole areas of the target and a contacting electrode disposed over the holes connecting the film target in the holes to the webs. A readout scanning electron beam is generated in the envelope to provide on the electrode an electric signal proportional to the resistance of the target due to the thermal radiation in the web areas and proportional to the resistance of the target due to the thermal radiation in the hole areas. A processing circuit disposed externally of the envelope coupled to the electrode is responsive to the electric signal to make a side-by-side comparison of each of the hole area resistances of the target due to the thermal radiation with the surrounding web area resistance of the target due to the thermal radiation and to display only any change of resistance of the target in each of the hole areas due to the thermal radiation to reproduce the viewed object.

36 Claims, 4 Drawing Figures

THERMAL CAMERA TUBE

BACKGROUND OF THE INVENTION

This invention relates to camera tubes and more particularly to thermal camera tubes.

In earlier work in the ITT "Theta Camera Tube" and according to published reports on the closely related "Thermacon Camera Tube," one of the leading limitations on useful sensitivity was the non-uniformity of the thermal retina, a thin bolometric type film and other non-uniformity processes, such as readout scanning, which led to serious shading signal amplitudes. In effect, low scene signals could not be seen over and above the values of signals caused by these various sources of non-uniform responses. This problem is clearly accelerated, compared to conventional TV camera tubes, because the thermal signal radiations to be detected are in the region of 0.1 to 1.0% of the constant background thermal flux level always present. Thus, a target non-uniformity of 1 to 10% which is often encountered would completely swamp out or hide the desired 0.1 – 1.0% true thermal signal radiations.

SUMMARY OF THE INVENTION

An object of the present invention is to provide an improved thermal camera tube.

Another object of the present invention is to provide a thermal camera tube to detect a thermal signal input image radiation without seeing non-uniformities of the thermal-conversion retina and scanning system.

Still another object of the present invention is to provide a thermal camera tube which removes signal information due to the constant thermal background radiation from the viewed thermal scene.

A further object of the present invention is to provide a thermal camera tube wherein the viewed thermal scene is reproduced by the comparison of two signals, where one signal is a signal from a target area which is "hot" and the other signal is from a target area which is held at ambient temperature.

A feature of the present invention is the provision of in a thermal camera tube, a thermal retina disposed in a vacuum envelope to receive thermal radiation emitted from an object comprising: a bolometric thin film target; a heat sink mesh disposed between the thermal radiation and the target to support the target, the heat sink mesh having webs to define web areas of the target and holes surrounded by the webs to define hole areas of the target; and a contacting electrode disposed over the holes connecting the thin film target in the holes to the webs.

Another feature of the present invention is the provision of in a thermal camera tube, a system for processing thermal radiation emitted from an object comprising: a thermal retina disposed in a vacuum envelope to receive the thermal radiation including a bolometric thin film target, a heat sink mesh disposed between the thermal radiation and the target to support the target, the heat sink mesh having webs to define web areas of the target and holes surrounded by the webs to define hole areas of the target, and a contacting electrode disposed over the holes connecting the thin film target in the holes to the webs; and a processing circuit disposed externally of the envelope coupled to the electrode to make a side-by-side comparison of each of the resistance of the hole areas of the target due to the thermal radiation with the resistance of the surrounding web areas of the target due to the thermal radiation and to display only any change of resistance of the target in each of the hole areas due to the thermal radiation to reproduce the object.

A further feature of the present invention is the provision of a thermal camera tube for detecting and displaying thermal radiation emitted from an object comprising: a thermal retina disposed in a vacuum envelope to receive the thermal radiation including a bolometric thin film target, a heat sink mesh disposed between the thermal radiation and the target to support the target, the heat sink mesh having webs to define web areas of the target and holes surrounded by the webs to define hole areas of the target, and a contacting electrode disposed over the holes connecting the thin film target in the holes to the webs; means disposed in and surrounding the envelope to provide a readout scanning electron beam to provide on the electrode an electric signal proportional to the resistance of the target due to the thermal radiation absorbed in the web areas and proportional to the resistance of the target due to the thermal radiation absorbed in the hole areas; and a processing circuit disposed externally of the envelope coupled to the electrode, the processing circuit being responsive to the electric signal to make a side-by-side comparison of the resistance of each of the hole areas of the target due to the thermal radiation with the resistance of the surrounding web areas of the target due to the thermal radiation and to display only any change of resistance of the target in each of the hole areas due to the thermal radiation to reproduce the object.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
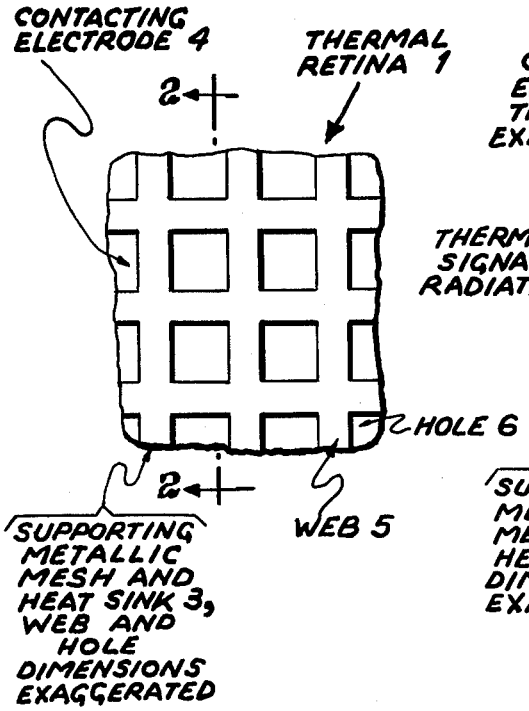
FIG. 1 is a front view of a thermal retina in accordance with the principles of the present invention.
Figure 2:
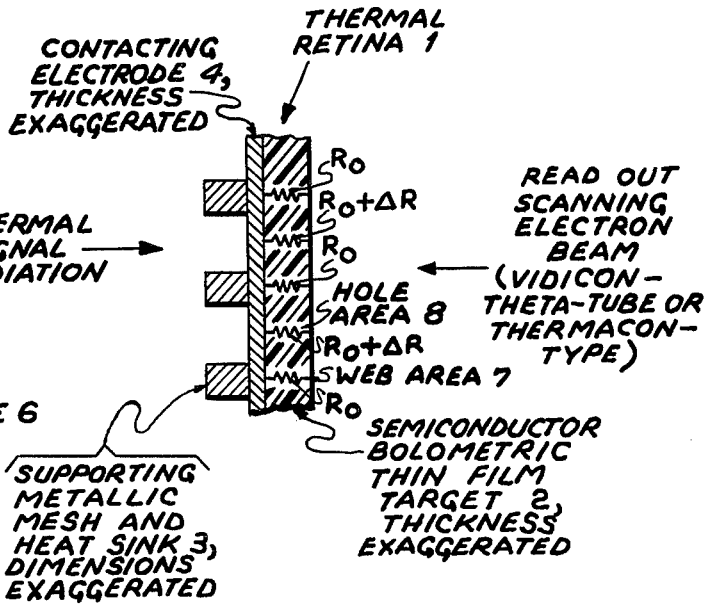
FIG. 2 is a cross-sectional view taken along line 2—2 of FIG. 1 of the thermal retina in accordance with the principles of the present invention.

Referring to FIGS. 1 and 2, the thermal retina 1 includes a semiconductor bolometric thin film target 2 supported by a supporting metallic mesh and heat sink 3 and a contact electrode 4, such as film or layer, disposed over the holes 6 connecting target 2 in holes 6 to webs 5 of mesh and heat sink 3. The target 2 is composed of a semiconductor, such as, for example, antimony trisulfide having a resistivity of $10^{10}$ – $10^{13}$ ohm cm (ohm centimeter), having a thickness in the range of 0.1 to 1.0 micron. Supporting mesh and heat sink 3 is composed of a metal, such as, for example, copper, which is sufficiently thermally-conductive to hold any film target 2 in contact with webs 5 at ambient temperature. Typically mesh and heat sink 3 is a 1000 "line per inch" heat sink mesh which maintains the web area 7 of target 2 defined by webs 5 at ambient temperature. The holes 6 each define a hole area 8 in the target 2.

In the hole area 8 the thin film target 2 is subjected to input thermal flux to be detected which absorbs this flux and, therefore, rises in temperature and changes its resistance according to usual bolometric laws. Suppose the resistance changes from $R_0$ (the non-signal ambient temperature base value in web area 7) to $R_0 + \Delta R$, where $\Delta R$ is the thermal signal radiation resistance change to be detected.

As a readout scanning beam (in a vidicon-, theta-tube-, or thermacon-like fashion) is moving over the surface of target 2, the scanning beam deposits electrical charges on retina 1 proportional to the magnitude of the thin film target resistance. The scanning beam will "see" in the hole areas 8 the resistance $R_0 + \Delta R$ and in the surrounding web areas 7 the resistance $R_0$. Thus, the output signal current from the thermal signal radiation to be detected will occur at a periodic rate, oscillating from an amount reciprocally proportional to $R_0$ in the web areas 7 and reciprocally proportional to $R_0 + \Delta R$ in the hole areas 8. By placing an electrical filter in the signal processing circuits, tuned to this periodic signal rate, it is possible to detect only the effective change signal due to $\Delta R$, and cancel out the reference signal due to $R_0$. In effect, the readout scanning electron beam makes a side-by-side comparison of each hole area 8 resistance with its surrounding web area 7 resistance to see if a change due to thermal signal input radiation has occurred.

This is exactly the type of signal operating principle needed to cancel out target-non-uniformity if those special variations occur over areas larger than one mesh hole 6. Thus, the value of $R_0$ may vary by large amounts over the surface of retina 1 without causing a variation, in correspondence, in the generated signal output. Furthermore, the abundant ambient radiation from the viewed scene (assumed to be at mesh temperature) merely maintains each hole area 8 at the resistance $R_0$ and, therefore, causes no generated output signal.

Figure 3:
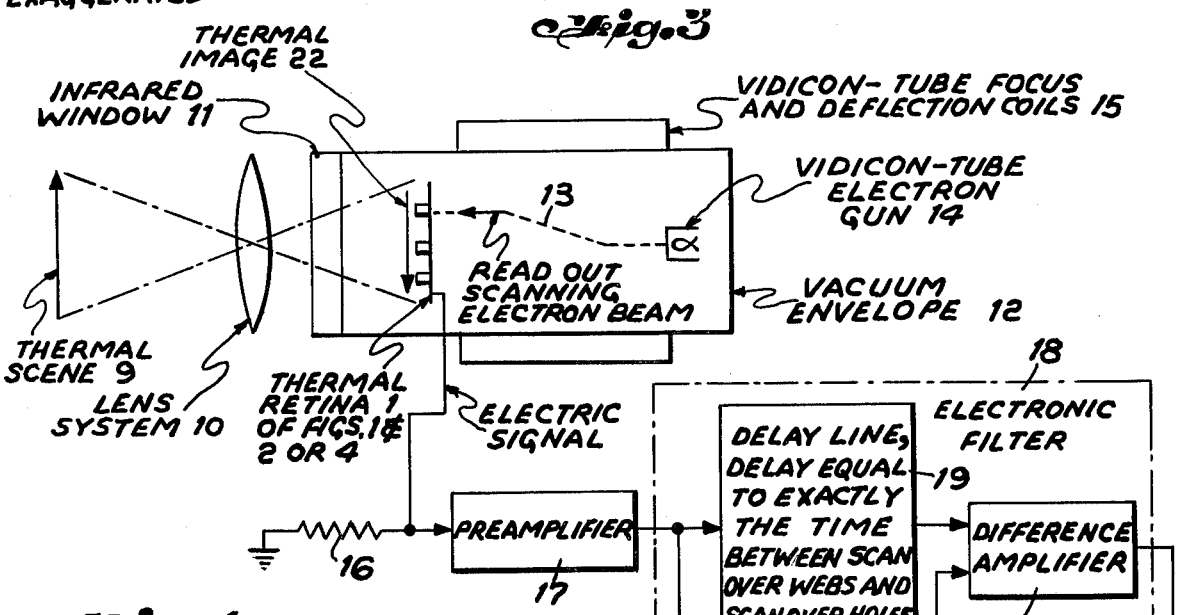
FIG. 3 is a schematic diagram partially in block form of a thermal camera tube in accordance with the principles of the present invention.

Referring to FIG. 3, there is illustrated therein a schematic diagram partially in block form of a thermal camera tube employing the thermal retina 1 of FIGS. 1 and 2 or the thermal retina 1' of FIG. 4 to be discussed hereinbelow. The thermal scene 9 is focused by a lens system 10 through an infra-red window 11 forming part of the vacuum envelope 12 onto thermal retina 1. The thermal image 22 formed on the retina 1 is at least partially absorbed by the electrode 4 and retina 1 causing a rise in temperature and a resistance change $\Delta R$. The readout scanning electron beam 13 which scans target 2 may be produced as in a vidicon tube employing a vidicon-tube electron gun 14 disposed within envelope 12' and a vidicon-tube focus and deflection coils 15 surrounding envelope 12. The electric signal present on contacting electrode 4 due to the readout scanning electron beam is reciprocally proportional to the resistance of the target in the hole area 8 ($R_0 + \Delta R$) and reciprocally proportional to the resistance of the target 2 in the web area 7 ($R_0$). This electric signal is coupled from electrode 4 to a load resistor 16 to which is coupled a preamplifier 17. The output of preamplifier 17 is coupled to electronic filter 18 so that only a signal proportional to $\Delta R$ is provided at the output thereof which is coupled to conventional cathode ray tube circuits, components and display tube 21 which displays only the signal $\Delta R$ to reproduce the thermal scene 9. Electronic filter 18 may take the form of a delay line 19 which is tuned to provide a delay equal to exactly the above-mentioned periodic rate of the time between the scan over webs 5 and the scan over holes 6. The output of delay line 19 and the output of preamplifier 17 are coupled to a difference amplifier 20 so that the output of difference amplifier 20 is a signal only proportional to $\Delta R$.

Alternately the readout scanning beam could be generated as in an image orthicon or image isocon television camera tube in which the signal modulation, due to charge deposited on the thermal retina 1, is detected in the portion of the scanning beam returned to the electron gun area, and amplified by an electron multiplier. Other standard methods of reading the resistance variations of light-sensitive television camera tube target films could also be utilized.

It should be noted that none of the components of the thermal camera tube of FIG. 3 are cooled in contrast to most other devices used to detect thermal images which require cooling. Therefore, due to the lack of necessity of cooling the components of the thermal camera tube of the present invention there is a definite economic and operational advantage over the prior art thermal camera tubes.

Figure 4:
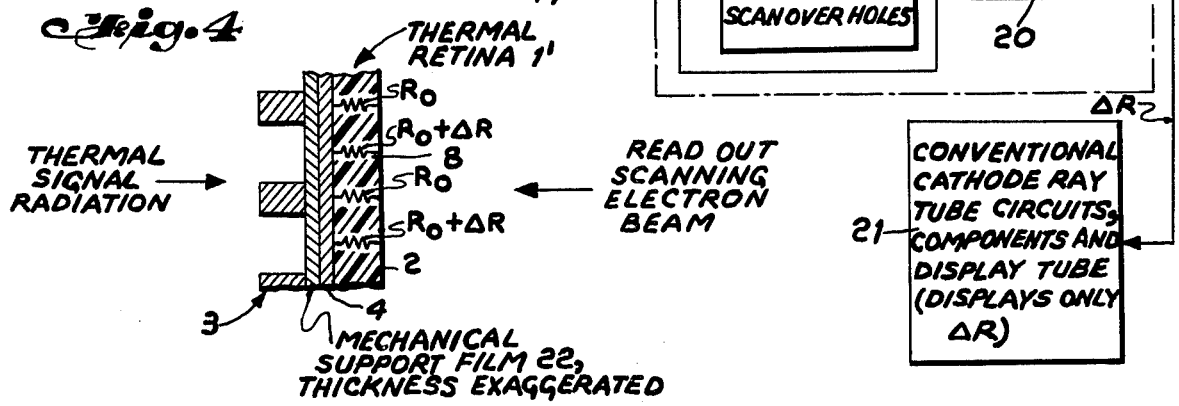
FIG. 4 is a cross-sectional view of an alternative thermal retina in accordance with the principles of the present invention.

Referring to FIG. 4, thermal retina 1' is exactly like thermal retina 1 of FIGS. 1 and 2 with the exception that a mechanical support film 22 is disposed between mesh and heat sink 3 and contacting electrode 4. Support film 22 is added, if necessary, to support bolometric film 3 and electrode 4 over the hole areas 8. Thus, support film 22 removes mechanical strength restrictions on bolometric film 3 material and, therefore, widens the possible choices of material for film 3.

In addition to mesh 3 acting as a support for film 2 and as a heat sink to avoid the spread of heat generated in film 2, the utilization of mesh 3 enables the utilization of a much thinner film 2 such that mesh 3 not only acts as a heat sink, but provides mechanical support of a much thinner film 2. For example, in the prior art there was a practical limit on the thickness of film 2 that could be employed since film 2 was supported at its outer periphery and was extremely fragile if it was less than 1 to 3 microns thick. The utilization of mesh 3 permits a film 2 to be utilized having a thickness of 0.1 to 0.3 microns. This ability to reduce the thickness of film 2 because of the support of mesh 3 not only reduces the heat transfer between adjacent elements, but also greatly increases the sensitivity of the resulting product by a factor which is greater than a 10 fold improvement.

While I have described above the principles of my invention in connection with specific apparatus it is to be clearly understood that this description is made only by way of example and not as a limitation to the scope of my invention as set forth in the objects thereof and in the accompanying claims.

I claim:

1. In a thermal camera tube, a thermal retina disposed in a vacuum envelope to receive thermal radiation emitted from an object comprising:

a bolometric thin film target;

a heat sink mesh disposed between said thermal radiation and said target to support said target, said heat sink mesh having webs to define web areas of said target and holes surrounded by said webs to define hole areas of said target; and a contacting electrode disposed over said holes connecting said thin film target in said holes to said webs.

2. A thermal retina according to claim 1, wherein said target is a thin semiconductor film.

3. A thermal retina according to claim 2, wherein said thin semiconductor film is a thin antimony trisulfide film.

4. A thermal retina according to claim 3, wherein said thin antimony trisulfide film has a thickness in the range of 0.1 to 1.0 micron.

5. A thermal retina according to claim 2, wherein said thin semiconductor film has a thickness in the range of 0.1 to 1.0 micron.

6. A thermal retina according to claim 1, wherein said heat sink mesh is a 1000 line per inch metallic mesh.

7. A thermal retina according to claim 6, wherein said metallic mesh is composed of a metal having a sufficient thermal conductivity to maintain said web areas of said target in contact with said webs at ambient temperature.

8. A thermal retina according to claim 7, wherein said metal is copper.

9. A thermal retina according to claim 1, wherein said target is a thin semiconductor film; and said heat sink mesh is a 1000 line per inch metallic mesh.

10. A thermal retina according to claim 9, wherein said semiconductor film has a thickness in the range of 0.1 to 1.0 micron; and said metallic mesh is composed of a metal having a sufficient thermal conductivity to maintain said web areas of said semiconductor film in contact with said webs at ambient temperature.

11. A thermal retina according to claim 10, wherein said semiconductor film is a thin antimony trisulfide film; and said metal is copper.

12. A thermal retina according to claim 9, wherein said semiconductor film is a thin antimony trisulfide film; and said metallic mesh is copper.

13. In a thermal camera tube, a system for processing thermal radiation emitted from an object comprising:

a thermal retina disposed in a vacuum envelope to receive said thermal radiation including
a bolometric thin film target,
a heat sink mesh disposed between said thermal radiation and said target to support said target, said heat sink mesh having webs to define web areas of said target and holes surrounded by said webs to define hole areas of said target, and
a contacting electrode disposed over said holes connecting said thin film target in said holes to said webs; and a processing circuit disposed externally of said envelope coupled to said electrode to make a side-by-side comparison of the resistance of each of said hole areas of said target due to said thermal radiation with the resistance of said surrounding web areas of said target due to said thermal radiation and to display only any change of resistance of said target in each of said hole areas due to said thermal radiation to reproduce said object.

14. A system according to claim 13, wherein said target is a thin semiconductor film.

15. A system according to claim 14, wherein said thin semiconductor film is a thin antimony trisulfide film.

16. A system according to claim 15, wherein said thin antimony trisulfide film has a thickness in the range of 0.1 to 1.0 micron.

17. A system according to claim 14, wherein said thin semiconductor film has a thickness in the range of 0.1 to 1.0 micron.

18. A system according to claim 13, wherein said heat sink mesh is a 1000 line per inch metallic mesh.

19. A system according to claim 18, wherein said metallic mesh is composed of a metal having a sufficient thermal conductivity to maintain said web areas of said target in contact with said webs at ambient temperature.

20. A system according to claim 19, wherein said metal is copper.

21. A system according to claim 13, wherein said processing circuit includes an electronic filter coupled to said electrode tuned to a periodic rate oscillating from the resistance of said target in said web areas to the resistance of said target in said hole areas to pass only said change of resistance of said target in said hole areas, and
a display means coupled to said filter to display only said change of resistance of said target in said hole areas.

22. A system according to claim 21, wherein said electronic filter includes a delay line having a predetermined delay coupled to said electrode, and
a difference amplifier coupled to said delay line and said electrode to provide an output signal equal to only said change of resistance of said target in said hole areas; and said display means included
a conventional cathode ray tube.

23. A system according to claim 13, wherein said target is a thin semiconductor film; said heat sink mesh is a 1000 inch per line metallic mesh; and said processing circuit includes an electronic filter coupled to said electrode tuned to a periodic rate oscillating from the resistance of said target in said web areas to the resistance of said target in said hole areas to pass only said change of resistance of said target in said hole areas, and
a display means coupled to said filter to display only said change of resistance of said target in said hole areas.

24. A system according to claim 23, wherein said semiconductor film has a thickness in the range of 0.1 to 1.0 micron; said metallic mesh is composed of a metal having a sufficient thermal conductivity to maintain said semiconductor film in contact with said web areas at ambient temperature; and said electronic filter includes a delay line having a predetermined delay coupled to said electrode, and
a difference amplifier coupled to said delay line and said electrode to provide an output signal equal to only said change of resistance of said target in said hole areas; and said display means included
a conventional cathode ray tube.

25. A thermal camera tube for displaying thermal radiation emitted from an object comprising:

a thermal retina disposed in a vacuum envelope to receive said thermal radiation including a bolometric thin film target, a heat sink mesh disposed between said thermal radiation and said target to support said target, said heat sink mesh having webs to define web areas of said target and holes surrounded by said webs to define hole areas of said target, and a contacting electrode disposed over said holes connecting said thin film target in said holes to said webs;

means disposed in and surrounding said envelope to provide a readout scanning electron beam to provide on said electron an electric signal proportional to the resistance of said target due to said thermal radiation in said web areas and proportional to the resistance of said target due to said thermal radiation in said hole areas; and a processing circuit disposed externally of said envelope coupled to said electrode, said processing circuit being responsive to said electric signal to make a side-by-side comparison of the resistance of each of said hole areas of said target due to said thermal radiation with the resistance of said surrounding web areas of said target due to said thermal radiation and to display only any change of resistance of said target in each of said hole areas due to said thermal radiation to reproduce said object.

26. A tube according to claim 25, wherein said target is a thin semiconductor film.

27. A tube according to claim 26, wherein said thin semiconductor film is a thin antimony trisulfide film.

28. A tube according to claim 27, wherein said thin antimony trisulfide film has a thickness in the range of 0.1 to 1.0 micron.

29. A tube according to claim 26, wherein said thin semiconductor film has a thickness in the range of 0.1 to 1.0 micron.

30. A tube according to claim 25, wherein said heat sink mesh is a 1000 line per inch metallic mesh.

31. A tube according to claim 30, wherein said metallic mesh is composed of a metal having a sufficient thermal conductivity to maintain said web areas of said target in contact with said webs at ambient temperature.

32. A tube according to claim 31, wherein said metal is copper.

33. A tube according to claim 25, wherein said processing circuit includes an electronic filter coupled to said electrode tuned to a periodic rate oscillating from the resistance of said target in said web areas to the resistance of said target in said hole areas to pass only said change of resistance of said target in said hole areas, and a display means coupled to said filter to display only said change of resistance of said target in said hole areas.

34. A tube according to claim 33, wherein said electronic filter includes a delay line having a predetermined delay coupled to said electrode, and a difference amplifier coupled to said delay line and said electrode to provide an output signal equal to only said change of resistance of said target in said hole areas; and said display means included a conventional cathode ray tube.

35. A tube according to claim 25, wherein said target is a thin semiconductor film; said heat sink mesh is a 1000 line per inch metallic mesh; and said processing circuit includes an electronic filter coupled to said electrode tuned to a periodic rate oscillating from the resistance of said target in said web areas to the resistance of said target in said hole areas to pass only said change of resistance of said target in said hole areas, and a display means coupled to said filter to display only said change of resistance of said target in said hole areas.

36. A tube according to claim 35, wherein said semiconductor film has a thickness in the range of 0.1 to 1.0 micron; said metallic mesh is composed of a metal having a sufficient thermal conductivity to maintain said semiconductor film in contact with said web areas as ambient temperature; and said electronic filter includes a delay line having a predetermined delay coupled to said electrode, and a difference amplifier coupled to said delay line and said electrode to provide an output signal equal to only said change of resistance of said target in said hole areas; and said display means included a conventional cathode ray tube.

* * * * *